US007018301B1

(12) United States Patent
Cascerceri et al.

(10) Patent No.: US 7,018,301 B1
(45) Date of Patent: Mar. 28, 2006

(54) DYNAMIC SWING TRAINING AID FOR SPORTS

(76) Inventors: Frank J. Cascerceri, 84 Golfview Dr., Ivyland, PA (US) 18974; John R. Eccleston, 75 Eisenhard Dr., Ivyland, PA (US) 18974

( * ) Notice: Subject to any disclaimer, the term of this patent is extended or adjusted under 35 U.S.C. 154(b) by 0 days.

(21) Appl. No.: 11/030,072

(22) Filed: Jan. 7, 2005

(51) Int. Cl.
*A63B 69/36* (2006.01)

(52) U.S. Cl. ..... 473/270; 473/266; 473/269

(58) Field of Classification Search ..... 473/207, 473/217–219, 266, 269–273
See application file for complete search history.

(56) References Cited

U.S. PATENT DOCUMENTS 4,023,810 A * 5/1977 Lorang ..... 473/218
4,088,325 A * 5/1978 Sutton ..... 473/269
5,263,863 A * 11/1993 Stefani et al. ..... 473/269
5,916,036 A * 6/1999 Hamilton ..... 473/269
5,976,027 A * 11/1999 Kachmar ..... 473/273
6,723,004 B1 * 4/2004 Florian ..... 473/270

* cited by examiner

*Primary Examiner*—Nini F. Legesse
(74) *Attorney, Agent, or Firm*—Gregory J. Gore

(57) ABSTRACT

A rocking footplate alerts an athlete such as a golfer or a baseball player to the occurrence of improper rear foot weight placement. The footplate is placed under the athlete's rear foot and includes upper and lower plates which are joined by a hinge having an axis of rotation which is aligned with the center of the foot. The bottom of the device includes spikes which engage the ground to provide a stable base for the hinged top plate. The top plate is in the anatomical shape of a foot to aid proper foot placement on the device.

6 Claims, 3 Drawing Sheets

DYNAMIC SWING TRAINING AID FOR SPORTS

FIELD OF THE INVENTION

The present invention relates to training equipment for sports such as golf or baseball used to indicate proper weight shift while performing a correct swing. More specifically, it relates to the side-to-side distribution of weight of the golfer's or batter's rear foot.

BACKGROUND OF THE INVENTION

It is generally known that proper weight shift and distribution of weight are important aspects of playing sports such as golf and baseball. For example, a correct golf swing is essential for accurately and forcefully striking the ball. The greatest accuracy and power is achieved when weight is shifted first to the back foot and then to the front foot during the swing. In addition, there has been much attention given to the proper placement of weight with regard to parts of the rear foot. It is generally accepted that muscles of the rear leg and ankle should be utilized so that the weight on the rear foot is kept to the inside. There is a tendency for poor golfers to roll their rear foot to the outside when taking the club back during the backswing. This places weight on the outside of the rear foot which is considered improper weight placement that affects use of the muscles of the legs and hips which in turn adversely affects the power of the swing and hence the distance the golf ball travels. Similarly, it has been observed that children learning to play baseball often move forward away from the pitcher when swinging the bat. This rearward weight shift is undesirable and results in reduced swing accuracy and hitting power.

There are many training devices to help with the problem of improper rear foot weight placement, however these are primarily static wedge-shaped devices which keep the batter's or golfer's rear foot canted inwardly to ensure that too much weight is not transferred to the outside of the rear foot during the backswing. However, it is still possible using these devices for too much weight to be applied to the outside of the rear foot and, in fact, the elevation of the outside edge of the golfer's rear foot by the wedge may tend to increase the weight transferred to the outside edge rather than decrease it. There are also training devices for weight shift on the front foot such as shown in U.S. Pat. No. 5,445,384. This patent discloses a golf training device which includes a hemispherical body adapted to be secured to the shoe sole of the user. The body tends to elevate the front of the foot thereby shifting the weight so much to the heel of the foot. During the backswing and downswing, the body rolls over the ground and magnifies the feeling resulting from shifting of weight of the front foot during the backswing and downswing. While this device may be suitable for training the shifting of weight to the front foot, it has no applicability to rear foot weight distribution.

There are also various training devices for developing optimal stance and batting stride for baseball batters, however these are primarily stance indicators for foot positioning rather than weight distribution. An example of such a training aid for baseball includes U.S. Pat. No. 5,642,880 issued to Wiseman et al. which discloses a mat marked with indicia and a pressure-sensitive area for temporarily indicating the final position of the baseball batter's front foot subsequent to swinging the bat.

There is therefore a need in the art for an athlete's weight placement training aid which alerts the athlete when too much weight is being shifted to the outside of the rear foot during the backswing and which prevents this improper weight transfer. There is also a need for a weight shift training device for baseball to signal the batter when his weight has improperly shifting to the rear during the swing of the bat when hitting the ball.

SUMMARY OF THE INVENTION

In order to meet the needs in the art, the present invention has been devised which alerts the athlete such as a golfer or baseball player to the occurrence of improper outside edge rear foot weight placement. This is provided by a rocking footplate placed under the athlete's rear foot. The training footplate of the invention includes upper and lower plates which are joined by a hinge having an axis of rotation which is aligned with the central axis (i.e. heel to toe) of the footplate. The bottom plate engages the ground with spikes and serves as a stable base for the hinged top plate.

In relation to the game of golf, when using the device, an angled or wedged footing press is presented to the golfer and so long as weight is maintained on the inside edge of the foot, the wedge remains stable and helps maintain the proper weight placement. If however, during the backswing, weight is improperly shifted to the outside of the rear foot, the footplate will rock backward. This provides a sensation to the golfer that is readily felt and which signals that corrective action should be taken by muscles of the leg and ankle to redirect the weight to the inside of the foot. This corrective action then causes the footplate to rock forward into the desired wedge support position where it began. Thus, the training device provides a dynamic wedge support for maximizing power while providing an effective means of signaling when improper weight placement has occurred.

One of the many advantages of the present invention is that it is very effective while providing an extremely simple and uncomplicated construction. It may be made of lightweight and very durable materials that make it easy to carry and use. Because of the symmetry of its design it may be used equally by both right-handed and left-handed golfers.

More specifically, the inventors have created a sports swing training aid comprising a footplate having a substantially planar top surface, a substantially planar baseplate, and means for providing a longitudinal axis of rotation between the footplate and the baseplate which is substantially parallel to the planes of the plates. A plurality of spikes extend from the bottom of the baseplate to engage the ground. Both plates are substantially hourglass-shaped. The means for providing a longitudinal axis of rotation is preferably a hinge joint comprising a semi-circular barrel member extending longitudinally along a bottom of the footplate and an arcuate trough extending longitudinally along a top surface of the baseplate. The barrel and trough members are compatibly shaped to provide load-bearing rotational elements of great surface area. Fore and aft retention lugs affixed to the baseplate engage opposite ends of the barrel member for snap-fit attachment of the footplate to the baseplate. All parts of the device are preferably formed from a lightweight, high-strength molded plastic.

It is therefore the general object of the invention to provide an effective training device for athletes for detecting weight shift while assuming a given stance. It is therefore an object of the invention to provide a golf training device which effectively encourages proper rear foot weight placement throughout the golf swing. It is a further object of the invention to provide a golf swing training apparatus which is economical to manufacture, easy to maintain, lightweight, and uncomplicated to use. Further objects and advantages of the invention will be readily apparent to those of skill in the art from the following drawings and description of the preferred embodiment.

DESCRIPTION OF THE PREFERRED EMBODIMENT

Figure 1:
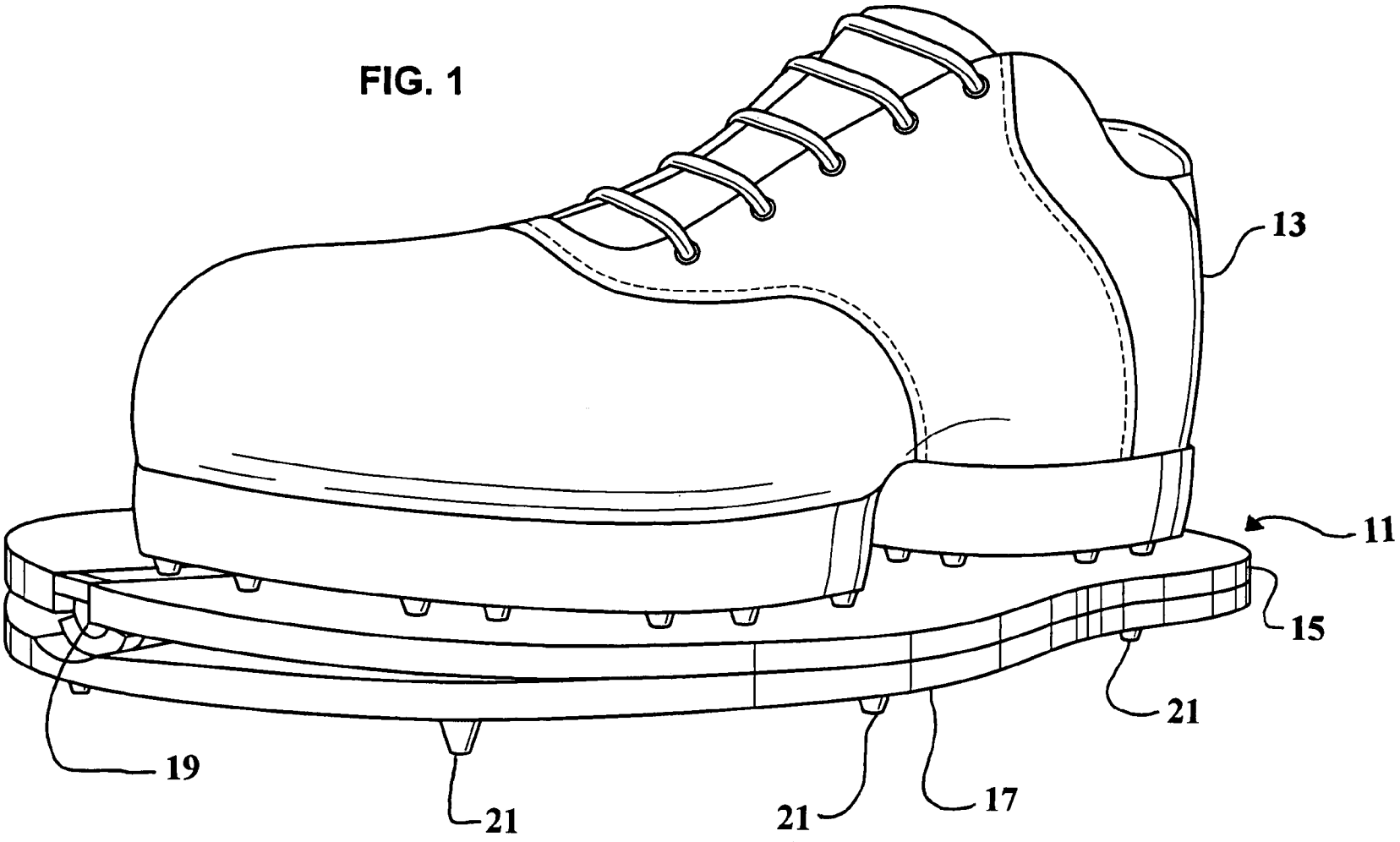
FIG. 1 is a top right front perspective view of the present invention with a golfer's shoe showing the proper position of the golfer's foot when in use.

While the following description of the preferred embodiment is taken from the point of view of a golfer, it should be understood that the device may be applied to other sports such as baseball. Referring now to FIG. 1, the present invention 11 is shown positioned correctly beneath the shoe 13 of the golfer's or baseball batter's rear foot. The invention includes a footplate 15 and a baseplate 17 which are rotationally secured by hinge joint 19. Ground-engaging spikes 21 extend downwardly from the bottom of the baseplate. As shown in this position, weight is being properly applied to the inside portion of the golfer's foot which causes the footplate to rotate to that direction so that the inner surfaces of the baseplate and footplate are in contact on that side. With this weight distribution, the device assumes a stable weight-bearing wedge-shaped configuration. Both the footplate and the baseplate have an anatomical footprint shape to aid the golfer in placing his/her foot properly in the center of the footplate which aligns the centerline of the foot along the longitudinal axis of the hinge joint 19.

Figure 2:
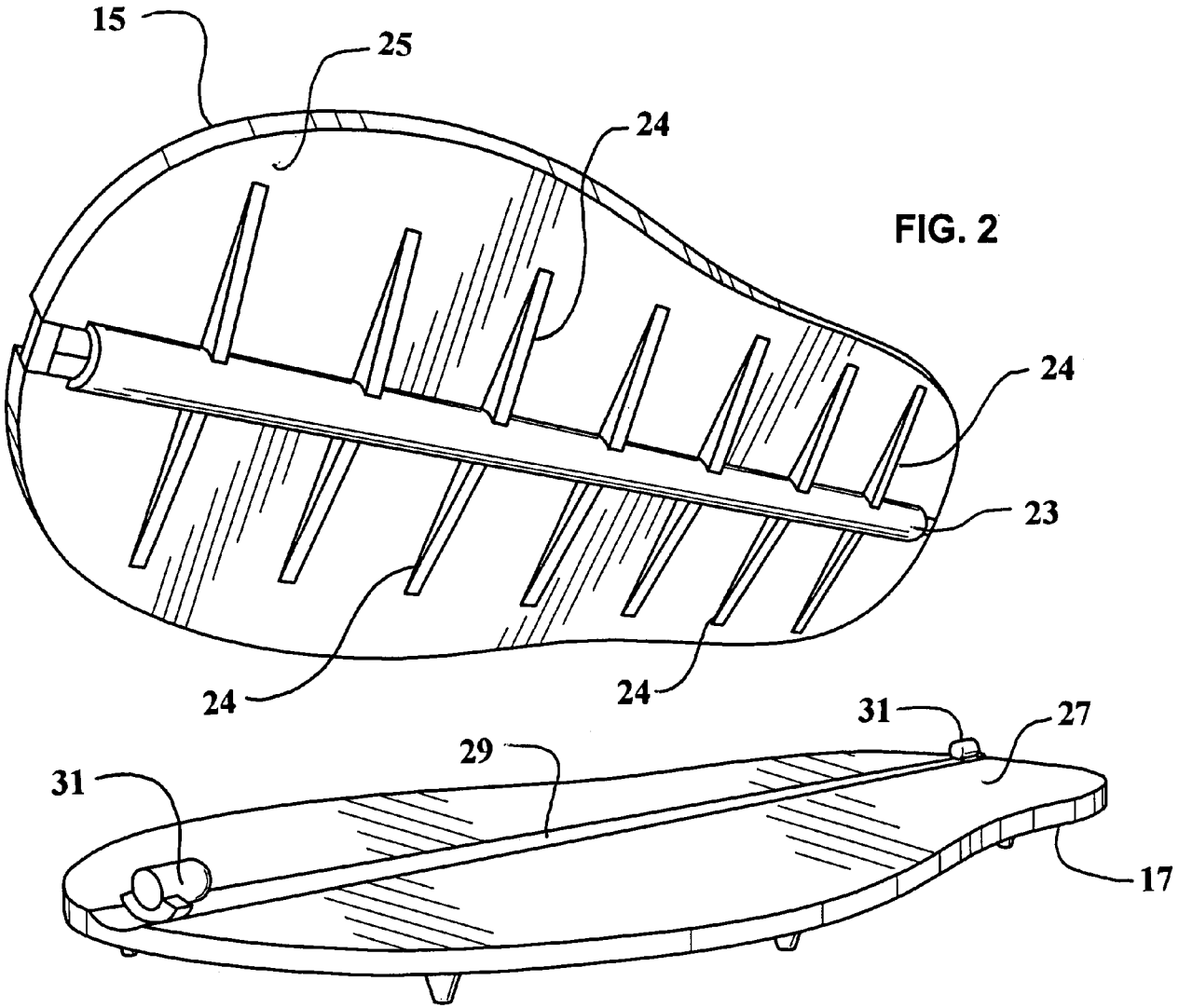
FIG. 2 is an exploded assembly view of the invention showing detail of the bottom of the footplate and top of the baseplate.

Referring now to FIG. 2, the inner-facing surfaces of the footplate 15 and baseplate 17 are shown. The footplate includes a bottom surface 25 which holds a barrel portion of the hinge joint 23 which is essentially a semi-cylindrical structure supported by the reinforcement braces 24. The baseplate 17 includes a top surface 27 which includes a longitudinally extending arcuate trough 29 and fore and aft retention lugs 31. When the footplate and the baseplate are joined, the retention lugs snap-fit into the open ends of barrel member 23 to rotationally secure the footplate 15 to the baseplate 17.

Figure 3:
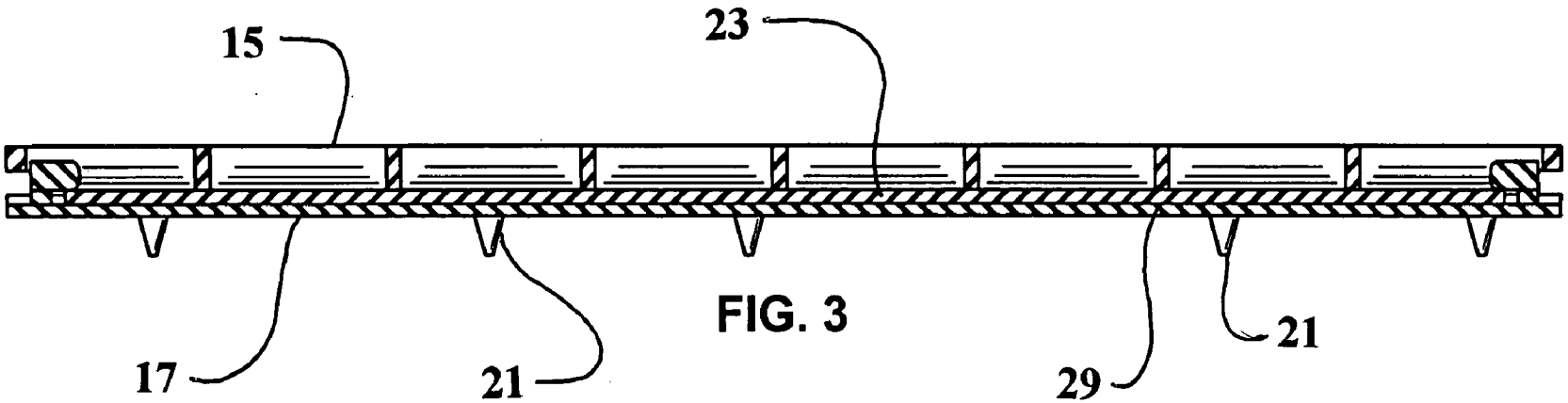
FIG. 3 is a side elevation longitudinal cross-section view.

Referring now to FIG. 3, the longitudinal cross-section of the joined components of the device shows the abutment of the outside surface of the barrel member 23 along substantially the entire length of the inside surface of the trough 29. Extending downwardly from a bottom of the baseplate are spikes 21 which penetrate the ground to secure the device against sliding. The barrel and trough configuration of the hinge joint provides a great amount of surface area between these load-bearing components of the hinge which ensure durability of the joint. The snap-fit attachment/detachment of the footplate 15 to the baseplate 17 permits their inside surfaces to be easily cleaned. Both components are preferably molded from a high strength, light-weight plastic thus providing economy of manufacture.

It should be understood that there may be other modifications and changes to the present invention that will be obvious to those of skill in the art from the foregoing description, however, the present invention should be limited only by the following claims and their legal equivalents.

What is claimed is:

1. A sports swing training aid, comprising:

a footplate having a substantially planar top surface;

a substantially planar baseplate;

means for providing a longitudinal axis of rotation between said footplate and said baseplate which is substantially parallel to planes of said plates;

means for providing a longitudinal axis of rotation comprises a semi-cylindrical barrel member extending longitudinally along a bottom of said footplate and further includes an arcuate trough extending longitudinally along a top surface of the baseplate which compatibly engages said barrel member; and fore and aft retention lugs affixed to said baseplate which engage opposite ends of said barrel member for attachment of the footplate to the baseplate.

2. The training aid of claim 1 further including a plurality of spikes extending from the bottom of said baseplate.

3. The training aid of claim 1 wherein said footplate is substantially hourglass shaped.

4. The training aid of claim 1 wherein said means for providing a longitudinal axis of rotation includes a hinge joint.

5. The training aid of claim 1 wherein said retention lugs engage said barrel member by snap-fit.

6. The training aid of claim 1 wherein the footplate and the baseplate are composed of molded plastic.

* * * * *